United States Patent [19]

Logsdon et al.

[11] Patent Number: 5,024,781

[45] Date of Patent: Jun. 18, 1991

[54] AZEOTROPE-LIKE COMPOSITIONS OF 1,1-DICHLORO-1-FLUOROETHANE, DICHLOROTRIFLUOROETHANE, METHANOL AND A MONO- OR DI-CHLORINATED $C_2$ OR $C_3$ ALKANE

[75] Inventors: Peter B. Logsdon; Leonard M. Stachura, both of Erie; Ellen L. Swan, Niagara; Rajat S. Basu, Erie, all of N.Y.

[73] Assignee: Allied-Signal Inc., Morris Township, Morris County, N.J.

[21] Appl. No.: 435,923

[22] Filed: Nov. 13, 1989

[51] Int. Cl.[5] ..... C11D 7/30; C11D 7/50

[52] U.S. Cl. ..... 252/171; 134/12; 134/38; 134/39; 134/40; 203/67; 252/170; 252/172; 252/DIG. 9

[58] Field of Search ..... 252/153, 162, 170, 171, 252/172, 364, DIG. 9; 134/12, 38, 39, 40; 203/67

[56] References Cited

U.S. PATENT DOCUMENTS

| | | | |
|---|---|---|---|
| 4,863,630 | 9/1989 | Swan et al. | 252/171 |
| 4,894,176 | 1/1990 | Swan et al. | 252/171 |
| 4,900,470 | 2/1990 | Lind et al. | 252/171 |
| 4,904,407 | 2/1990 | Swan et al. | 252/171 |
| 4,960,535 | 10/1990 | Logsdon et al. | 252/171 |

FOREIGN PATENT DOCUMENTS

| | | |
|---|---|---|
| 103686 | 4/1989 | Japan . |
| 136981 | 5/1989 | Japan . |
| 136982 | 5/1989 | Japan . |
| 137253 | 5/1989 | Japan . |
| 137259 | 5/1989 | Japan . |
| 138300 | 5/1989 | Japan . |

OTHER PUBLICATIONS

Serial No. 362,294 filed Jun. 6, 1989.

*Primary Examiner*—Paul Lieberman
*Assistant Examiner*—Linda D. Skaling
*Attorney, Agent, or Firm*—Colleen D. Szuch; Jay P. Friedenson

[57] ABSTRACT

Stable azeotrope-like compositions comprising 1,1-dichloro-1-fluoroethane, dichlorotrifluoroethane, methanol, and a mono- or di-chlorinated $C_2$ or $C_3$ alkane which are useful in a variety of industrial cleaning applications.

51 Claims, No Drawings

AZEOTROPE-LIKE COMPOSITIONS OF 1,1-DICHLORO-1-FLUOROETHANE, DICHLOROTRIFLUOROETHANE, METHANOL AND A MONO- OR DI-CHLORINATED $C_2$ OR $C_3$ ALKANE

FIELD OF THE INVENTION

This invention relates to azeotrope-like mixtures of 1,1-dichloro-1-fluoroethane, dichlorotrifluoroethane, methanol and a mono- or di-chlorinated $C_2$ or $C_3$ alkane. These mixtures are useful in a variety of vapor degreasing, cold cleaning and solvent cleaning applications including defluxing.

CROSS-REFERENCES TO RELATED APPLICATIONS

Co-pending, commonly assigned application Ser. No.: 297,467, filed Jan. 19, 1989, discloses azeotrope-like mixtures of 1,1-dichloro-1-fluoroethane, dichlorotrifluoroethane and methanol.

Issued, commonly assigned U.S. Pat. No.: 4,863.630. discloses azeotrope-like mixtures of 1,1-dichloro-1-fluoroethane, dichlorotrifluoroethane and ethanol.

Co-pending commonly assigned application Ser. No.: 362,294, filed June 6, 1989, discloses azeotrope-like mixtures of 1,1-dichloro-1-fluoroethane and dichlorotrifluoroethane.

Issued, commonly assigned U.S. Pat. No.: 4,842,764, discloses azeotrope-like mixtures of 1,1-dichloro-1-fluoroethane and methanol.

Co-pending, commonly assigned application Ser. No.: 423,993, filed Oct. 19, 1989, discloses azeotrope-like mixtures of dichlorotrifluoroethane and methanol.

BACKGROUND OF THE INVENTION

Fluorocarbon based solvents have been used extensively for the degreasing and otherwise cleaning of solid surfaces, especially intricate parts and difficult to remove soils.

In its simplest form, vapor degreasing or solvent cleaning consists of exposing a room temperature object to be cleaned to the vapors of a boiling solvent. Vapors condensing on the object provide clean distilled solvent to wash away grease or other contaminants. Final evaporation of solvent from the object leaves the object free of residue. This is contrasted with liquid solvents which leave deposits on the object after rinsing.

A vapor degreaser is used for difficult to remove soils where elevated temperature is necessary to improve the cleaning action of the solvent, or for large volume assembly line operations where the cleaning of metal parts and assemblies must he done efficiently. The conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the art. For example, Sherliker et al. in U.S. Pat. No. 3,085,918 disclose such suitable vapor degreasers comprising a boiling sump, a clean sump, a water separator, and other ancillary equipment.

Cold cleaning is another application where a number of solvents are used. In most cold cleaning applications the soiled part is either immersed in the fluid or wiped with cloths soaked in solvents and allowed to air dry.

Recently, nontoxic nonflammable fluorocarbon solvents like trichlorotrifluoroethane have been used extensively in degreasing applications and other solvent cleaning applications. Trichlorotrifluoroethane has been found to have satisfactory solvent power for greases, oils, waxes and the like. It has therefore found widespread use for cleaning electric motors, compressors, heavy metal parts, delicate precision metal parts, printed circuit boards, gyroscopes, guidance systems, aerospace and missile hardware, aluminum parts, etc.

The art has looked towards azeotropic compositions having fluorocarbon components because the fluorocarbon components contribute additionally desired characteristics, like polar functionality, increased solvency power, and stabilizers. Azeotropic compositions are desired because they do not fractionate upon boiling. This behavior is desirable because in the previously described vapor degreasing equipment with which these solvents are employed, redistilled material is generated for final rinse-cleaning. Thus, the vapor degreasing system acts as a still. Therefore, unless the solvent composition is essentially constant boiling, fractionation will occur and undesirable solvent distribution may act to upset the cleaning and safety of processing. For example, preferential evaporation of the more volatile components of the solvent mixtures would result in mixtures with changed compositions which may have less desirable properties, such as lower solvency towards soils, less inertness towards metal, plastic or elastomer components, and increased flammability and toxicity.

The art is continually seeking new fluorocarbon based azeotropic mixtures which offer alternatives for new and special applications for vapor degreasing and other cleaning applications. Currently, fluorocarbon based azeotrope-like mixtures are of particular interest because they are considered to be stratospherically safe substitutes for presently used fully halogenated chlorofluorocarbons. The latter have been implicated in causing environmental problems associated with the depletion of the earth's protective ozone layer. Mathematical models have substantiated that hydrochlorofluorocarbons, like 1,1-dichloro-1-fluoroethane (HCFC-141b) and dichlorotrifluoroethane (HCFC-123 or HCFC-123a), have a much lower ozone depletion potential and global warming potential than the fully halogenated species.

Accordingly, it is an object of the invention to provide novel environmentally acceptable azeotropic compositions which are useful in a variety of industrial cleaning applications.

It is another object of the invention to provide azeotrope-like compositions which are liquid at room temperature and which will not fractionate under conditions of use.

Other objects and advantages of the invention will become apparent from the following description.

SUMMARY OF THE INVENTION

The invention relates to novel azeotrope-like compositions which are useful in a variety of industrial cleaning applications. Specifically, the invention relates to compositions based on 1,1-dichloro-1-fluoroethane and dichlorotrifluoroethane which are essentially constant boiling, environmentally acceptable, non-fractionating, and which remain liquid at room temperature.

DETAILED DESCRIPTION OF THE INVENTION

In accordance with the invention, novel azeotrope-like compositions have been discovered comprising from about 25 to about 98 weight percent 1,1-dichloro-1-fluoroethane, from about 1 to about 69 weight percent dichlorotrifluoroethane selected from the group consisting of 1,1-dichloro-2,2,2-trifluoroethane, 1,2-dichloro-1,2,2-trifluoroethane and a mixture of 1,1-dichloro-2,2,2-trifluoroethane and 1,2-dichloro-1,2,2-trifluoroethane, from about 1 to about 4 weight percent methanol and from about 0.1 to about 4 weight percent of a mono- or dichlorinated $C_2$ or $C_3$ alkane selected from the group consisting of 1-chloropropane, 2-chloropropane and 1,1-dichloroethane, wherein said compositions boil at about 30.3° C.±about 1.2° C. at 760 mm Hg. Dichlorotrifluoroethane exists in three isomeric forms, 1,1-dichloro-2,2,2-trifluoroethane (HCFC-123), 1,2-dichloro-1,2,2-trifluoroethane (HCFC-123a), and 1,1-dichloro-1,2,2-trifluoroethane (HCFC-123b). For purposes of this invention, dichlorotrifluoroethane will refer only to the HCFC-123 and HCFC-123a isomers. Each of these isomers exhibits the properties of the invention. Hence either isomer may be used as well as mixtures of the isomers in any proportion. When the chlorinated alkane is a mono-chlorinated propane, either isomer or a mixture of the isomers may be used in any proportion.

HCFC-141b has a low ozone depletion potential. HCFC-123 has a still lower ozone depletion potential. When these materials are combined in effective amounts with the chlorinated alkane component of the invention, a very low ozone depleting composition result. HCFC-141b and HCFC-123 also suppress the flammability of the chlorinated alkane component when used in effective amounts. Methanol and the chlorinated alkane component exhibit superior solvent properties. Hence, when these materials, i.e., HCFC-123, HCFC-141b, methanol, and the chlorinated alkane component, are combined in effective amounts, a novel, environmentally acceptable, nonflammable cleaning solvent results.

When 2-chloropropane is the chlorinated alkane component of the invention, the azeotrope-like compositions comprise from about 25 to about 98 weight percent HCFC-141b, from about 1 to about 67 weight percent dichlorotrifluoroethane, from about 0.5 to about 4 weight percent 2-chloropropane and from about 1 to about 4 weight percent methanol.

In a preferred embodiment of the invention using 2-chloropropane, the azeotrope-like compositions of the invention comprise from about 57 to about 97 weight percent of HCFC-141b, from about 1 to about 35 weight percent of dichlorotrifluoroethane, from about 0.5 to about 4 weight percent of 2-chloropropane and from about 1 to about 4 weight percent methanol and boil at about 30.9° C. at 760 mm Hg.

In a more preferred embodiment of the invention containing 2-chloropropane, the azeotrope-like compositions of the invention comprise from about 62 to about 95 weight percent of HCFC-141b, from about 2 to about 31 weight percent of dichlorotrifluoroethane, from about 1 to about 3 weight percent of 2-chloropropane, and from about 2 to about 4 weight percent methanol and boil at about 30.9° C. at 760 mm Hg.

In the most preferred embodiment of the invention containing 2-chloropropane, the azeotrope-like compositions of the invention comprise from about 63 to about 92 weight percent HCFC-141b, from about 5 to about 30 weight percent of dichlorotrifluoroethane, from about 2 to about 4 weight percent of methanol, and from about 1 to about 3 weight percent of 2-chloropropane and boil at about 30.9° C. at 760 mm Hg.

When 1-chloropropane is the chlorinated alkane component of the invention, the azeotrope-like compositions comprise from about 25 to about 98 weight percent HCFC-141b, from about 1 to about 69 weight percent dichlorotrifluoroethane, from about 0.1 to about 2 weight percent 1-chloropropane and from about 1 to about 4 weight percent methanol and boil at about 30.9° C. at 760 mm Hg.

In a preferred embodiment of the invention using 1-chloropropane, the azeotrope-like compositions of the invention comprise from about 59 to about 98 weight percent HCFC-141b, from about 1 to about 35 weight percent dichlorotrifluoroethane, from about 0.1 to about 2 weight percent 1-chloropropane, and from about 1 to about 4 weight percent methanol and boil at about 30.9° C. at 760 mm Hg.

In a more preferred embodiment of the invention where 1-chloropropane is used, the azeotrope-like compositions comprise from about 63 to about 96 weight percent HCFC-141b, from about 2 to about 31 weight percent dichlorotrifluoroethane, from about 0.2 to about 2 weight percent 1-chloropropane and from about 2 to about 4 weight percent methanol and boil at about 30.9° C. at 760 mm Hg.

In the most preferred embodiment of the invention containing 1-chloropropane, the azeotrope-like compositions comprise from about 65 to about 92 weight percent HCFC-141b, from about 5.0 to about 30.0 weight percent dichlorotrifluoroethane, from about 0.2 to about 1 weight percent 1-chloropropane, and from about 2 to about 4 weight percent methanol and boil at about 30.9° C. at 760 mm Hg.

When 1,1-dichloroethane is the chlorinated alkane component of the invention, the azeotrope-like compositions comprise from about 25 to about 98 weight percent HCFC-141b, from about 1 to about 66 weight percent dichlorotrifluoroethane, from about 0.1 to about 3 weight percent 1,1-dichloroethane and from about 1 to about 6 weight percent methanol and boil at about 29.8° C. at 760 mm Hg.

In a preferred embodiment of the invention using 1,1-dichloroethane, the azeotrope-like compositions of the invention comprise from about 55 to about 98 weight percent HCFC-141b, from about 1 to about 37 weight percent dichlorotrifluoroethane, from about 0.1 to about 2 weight percent 1,1-dichloroethane and from about 1 to about 6 weight percent methanol and boil at about 29.8° C. at 760 mm Hg.

In a more preferred embodiment of the invention using 1,1-dichloroethane, the azeotrope-like compositions of the invention comprise from about 59 to about 96 weight percent HCFC-141b, from about 2 to about 33 weight percent dichlorotrifluoroethane, from about 0.1 to about 2 weight percent 1,1-dichloroethane and from about 2 to about 6 weight percent methanol and boil at about 29.8° C. at 760 mm Hg.

In the most preferred embodiment of the invention containing 1,1-dichloroethane, the azeotrope-like compositions comprise from about 62 to about 93 weight percent HCFC-141b, from about 5 to about 30 weight percent dichlorotrifluoroethane, from about 0.1 to about 2 weight percent 1,1-dichloroethane and from about 2 to about 6 weight percent methanol and boil at about 29.8° C. at 760 mm Hg.

The compositions of the invention containing a mixture of HCFC-123 and HCFC-123a behave like azeotropic compositions because the separate ternary azeotrope-like compositions containing HCFC-123 and HCFC-123a have boiling points so close to one another that they are indistinguishable for practical purposes.

It is known in the art that the use of more active solvents, like lower alkanols in combination with certain halocarbons such as trichlorotrifluoroethane, may have the undesirable result of attacking reactive metals such as zinc and aluminum, as well as certain aluminum alloys and chromate coatings such as are commonly employed in circuit board assemblies. The art has recognized that certain stabilizers, such as nitromethane, are effective in preventing metal attack by chlorofluorocarbon mixtures with such alkanols. Other candidate stabilizers for this purpose, such as disclosed in the literature, are secondary and tertiary amines, olefins and cycloolefins, alkylene oxides, sulfoxides, sulfones, nitrites and nitriles, and acetylenic alcohols or ethers. It is contemplated that such stabilizers as well as other additives may be combined with the azeotrope-like compositions of this invention.

The precise or true azeotrope compositions have not been determined but have been ascertained to be within the indicated ranges. Regardless of where the true azeotropes lie, all compositions within the indicated ranges, as well as certain compositions outside the indicated ranges, are azeotrope-like, as defined more particularly below.

It has been found that these azeotrope-like compositions are on the whole nonflammable liquids, i.e., exhibit no flash point when tested by the Tag Open Cup test method—ASTM D 1310-86.

From fundamental principles, the thermodynamic state of a fluid is defined by four variables: pressure, temperature, liquid composition and vapor composition, or P—T—X—Y, respectively. An azeotrope is a unique characteristic of a system of two or more components where X and Y are equal at the stated P and T. In practice, this means that the components of a mixture cannot be separated during distillation, and therefore are useful in vapor phase solvent cleaning as described above.

For the purpose of this discussion, by azeotrope-like composition is intended to mean that the composition behaves like a true azeotrope in terms of its constant boiling characteristics or tendency not to fractionate upon boiling or evaporation. Such compositions may or may not be a true azeotrope. Thus, in such compositions, the composition of the vapor formed during boiling or evaporation is identical or substantially identical to the original liquid composition. Hence, during boiling or evaporation, the liquid composition, if it changes at all, changes only minimally. This is contrasted with non-azeotrope-like compositions in which the liquid composition changes substantially during boiling or evaporation.

Thus, one way to determine whether a candidate mixture is "azeotrope-like" within the meaning of this invention, is to distill a sample thereof under conditions (i.e. resolution—number of plates) which would be expected to separate the mixture into its components. If the mixture is non-azeotropic or non-azeotrope-like, the mixture will fractionate, i.e. separate into its various components with the lowest boiling component distilling off first, etc. If the mixture is azeotrope-like, some finite amount of a first distillation cut will be obtained which contains all of the mixture components and which is constant boiling or behaves as a single substance. This phenomenon cannot occur if the mixture is not azeotrope-like i.e., it is not part of an azeotropic system. If the degree of fractionation of the candidate mixture is unduly great, then a composition closer to the true azeotrope must be selected to minimize fractionation. Of course, upon distillation of an azeotrope-like composition such as in a vapor degreaser, the true azeotrope will form and tend to concentrate.

It follows from the above that another characteristic of azeotrope-like compositions is that there is a range of compositions containing the same components in varying proportions which are azeotrope-like. All such compositions are intended to be covered by the term azeotrope-like as used herein. As an example, it is well known that at different pressures, the composition of a given azeotrope will vary at least slightly as will the boiling point of the composition. Thus, an azeotrope of A and B represents a unique type of relationship but with a variable composition depending on temperature and/or pressure. Accordingly, another way of defining azeotrope-like within the meaning of this invention is to state that such mixtures boil within about ±0.6° C. (at 760 mm Hg) of the boiling point of the most preferred compositions disclosed herein. As is readily understood by persons skilled in the art, the boiling point of the azeotrope will vary with the pressure.

In the process embodiment of the invention, the azeotrope-like compositions of the invention may be used to clean solid surfaces by treating the surfaces with said compositions in any manner well known in the art such as by dipping or spraying or use of conventional degreasing apparatus.

The 1,1-dichloro-1-fluoroethane, dichlorotrifluoroethane, methanol, 1,1-dichloroethane, and 1 or 2-chloropropane components of the invention are known materials. Preferably they should be used in sufficiently high purity so as to avoid the introduction of adverse influences upon the solvency properties or constant boiling properties of the system.

EXAMPLES 1-3

This set of examples further confirms the existence of the azeotropes between 1,1-dichloro-1-fluoroethane, dichlorotrifluoroethane, 1-chloropropane, and methanol via the method of distillation. They also illustrate the essentially constant boiling character of the mixture, i.e., non-fractionating during distillation.

A 5-plate Oldershaw distillation column with a cold water condensed automatic liquid dividing head was used for these examples. For Examples 1-3 the distillation column was charged with approximately 350 grams of a mixture of HCFC-141b, HCFC-123, 1-chloropropane, and methanol which were heated under total reflux for about an hour to ensure equilibration. A reflux ratio of 3:1 was employed for this particular distillation. Approximately 50 percent of the original charges were collected in four similar-sized overhead fractions. The compositions of these fractions were analyzed using gas chromatrography. Tables I & II show the compositions of the starting materials. The averages of the distillate fractions and the overhead temperatures are quite constant within the uncertainty associated with determining the compositions, indicating that the mixtures are azeotropic.

TABLE I

| EXAMPLE | STARTING MATERIAL (WT. %) HCFC-141b | HCFC-123 | MEOH | 1-CHLOROPROPANE |
|---|---|---|---|---|
| 1 | 84.97 | 9.99 | 3.02 | 2.02 |
| 2 | 69.05 | 25.92 | 3.01 | 2.02 |
| 3 | 85.04 | 9.95 | 4.01 | 1.00 |

| EXAMPLE | DISTILLATE FRACTION (WT. %) HCFC-141b | HCFC-123 | MEOH | 1-CHLOROPROPANE |
|---|---|---|---|---|
| 1 | 85.48 | 10.09 | 3.43 | 1.00 |
| 2 | 69.57 | 26.54 | 2.99 | 0.90 |
| 3 | 86.52 | 9.84 | 3.26 | 0.38 |

| EXAMPLE | BOILING POINT (°C.) | BAROMETRIC PRESSURE (mm Hg) | BOILING POINT CORRECTED TO 76 mm Hg (°C.) |
|---|---|---|---|
| 1 | 30.5 | 734.9 | 31.5 |
| 2 | 29.7 | 734.9 | 30.7 |
| 3 | 30.0 | 750.3 | 30.4 |
| | | | Mean: 30.9 ± 0.6° C. |

Examples 1-3 illustrate that HCFC-141b, HCFC-123, 1-chloropropane and methanol form a constant boiling mixture.

EXAMPLES 4–6

The azeotropic properties of HCFC-141b, HCFC-123a, 1-chloropropane and methanol are studied by repeating the experiment outlined in Examples 1–3. The results obtained are substantially the same ar those for HCFC-123, i.e., HCFC-141b, HCFC-123a, 1-chloropropane and methanol form a constant boiling mixture.

EXAMPLES 7–9

The azeotropic properties of HCFC-141b, a mixture of HCFC-123 and 123a, 1-chloropropane and methanol are studied by repeating the experiment outlined in Examples 1–3. The results obtained are substantially the same as those for HCFC-123, i.e., HCFC-141b, a mixture of HCFC-123 and 123a, 1-chloropropane, and methanol form a constant boiling mixtures.

EXAMPLES 10–12

This next set of examples further confirms the existence of azeotropes between 1,1-dichloro-1-fluoroethane, dichlorotrifluoroethane, methanol and 2-chloropropane via the method of distillation. They also illustrate that these mixtures do not fractionate during distillation.

Examples 10–12 were performed under the same conditions outlined in Examples 1–3 above.

TABLE II

| EXAMPLE | STARTING MATERIAL (WT. %) HCFC-141b | HCFC-123 | MEOH | 2-CHLOROPROPANE |
|---|---|---|---|---|
| 10 | 84.92 | 10.23 | 2.86 | 1.99 |
| 11 | 69.93 | 25.09 | 3.01 | 1.97 |
| 12 | 86.08 | 9.93 | 3.17 | 0.83 |

| EXAMPLE | DISTILLATE FRACTION (WT. %) HCFC-141b | HCFC-123 | MEOH | 2-CHLOROPROPANE |
|---|---|---|---|---|
| 10 | 85.18 | 9.98 | 3.24 | 1.60 |
| 11 | 69.60 | 25.83 | 3.03 | 1.54 |
| 12 | 86.09 | 9.85 | 3.42 | 0.64 |

| EXAMPLE | BOILING POINT (°C.) | BAROMETRIC PRESSURE (mm Hg) | BOILING POINT CORRECTED TO 760 mm Hg (°C.) |
|---|---|---|---|
| 10 | 30.5 | 747.3 | 31.0 |
| 11 | 30.5 | 745.7 | 31.0 |
| 12 | 30.0 | 745.7 | 30.6 |
| | | | Mean: 30.9 ± 0.3 |

Examples 10–12 illustrate that HCFC-141b, HCFC-123, 2-chloropropane and methanol form a constant boiling mixture.

EXAMPLES 13–15

The azeotropic properties of HCFC-141b, HCFC-123a, 2-chloropropane and methanol are studied by repeating the experiment outlined in Examples 1–3. The results obtained are substantially the same as those for HCFC-123, i.e., HCFC-141b, HCFC-123a, methanol and 2-chloropropane form a constant boiling mixture.

EXAMPLES 16–18

The azeotropic properties of HCFC-141b, a mixture of HCFC-123 and 123a, 2-chloropropane and methanol are studied by repeating the experiment outlined in Examples 1–3. The results obtained are substantially the same as those for HCFC-123, i.e., HCFC-141b, a mixture of HCFC-123 and 123a, methanol, and 2-chloropropane form a constant boiling mixture.

EXAMPLES 19–21

This set of examples further confirms the existence of azeotropes between 1,1-dichloro-1-fluoroethane, dichlorotrifluoroethane, methanol and 1,1-dichloroethane via the method of distillation.

Examples 19–21 were performed under the same conditions outlined in Examples 1–3 above except that the reflux ratio in the distillation was kept at 5:1.

TABLE III

| EXAMPLE | STARTING MATERIAL (WT. %) HCFC-141b | HCFC-123 | MEOH | 1,1-DICHLOROETHANE |
|---|---|---|---|---|
| 19 | 70.9 | 24.9 | 3.2 | 1.0 |
| 20 | 71.0 | 25.0 | 3.0 | 1.0 |
| 21 | 86.0 | 10.0 | 3.0 | 1.0 |

| EXAMPLE | DISTILLATE FRACTION (WT. %) HCFC-141b | HCFC-123 | MEOH | 1,1-DICHLOROETHANE |
|---|---|---|---|---|
| 19 | 70.3 | 26.6 | 3.0 | 0.1 |
| 20 | 69.3 | 24.9 | 5.3 | 0.4 |
| 21 | 84.7 | 9.6 | 5.4 | 0.2 |

| EXAMPLE | BOILING POINT (°C.) | BAROMETRIC PRESSURE (mm Hg) | BOILING POINT CORRECTED TO 760 mm Hg (°C.) |
|---|---|---|---|
| 19 | 30.0 | 747.0 | 30.3 |
| 20 | 29.0 | 739.0 | 29.5 |
| 21 | 29.0 | 739.0 | 29.5 |
| | | | Mean: 29.8 ± 0.5 |

Examples 19–21 illustrate that HCFC-141b, HCFC-123, 1,1-dichloroethane and methanol form a constant boiling mixture.

EXAMPLES 22–24

The azeotropic properties of HCFC-141b,

HCFC-123a, 1,1-dichloroethane and methanol are studied by repeating the experiment outlined in Examples 1–3 above. The results obtained are substantially the same as those for HCFC-123, i.e., HCFC-141b, HCFC-123a, methanol, and 1,1-dichloroethane form a constant boiling mixture.

EXAMPLES 25–27

The azeotropic properties of HCFC-141b, a mixture of HCFC-123/123a, 1,1-dichloroethane and methanol are studied by repeating the experiment outlined in Examples 1–3 above. The results obtained are substantially the same as those for HCFC- 123, i.e., HCFC-141b, a mixture of HCFC-123/123a, methanol and 1-1-dichloroethane form a constant boiling mixture.

What is claimed is:

1. Azeotrope-like compositions consisting essentially of from about 25 to about 98 weight percent 1,1-dichloro-1-fluoroethane, from about 1 to about 69 weight percent dichlorotrifluoroethane selected from the group consisting of 1,1-dichloro-2,2,2-trifluoroethane, 1,2 dichloro-1,2,2-trifluoroethane and a mixture of 1,1-dichloro-2,2,2-trifluoroethane and 1,2-dichloro-1,2,2-trifluoroethane, from about 1 to about 4 weight percent methanol and from about 0.1 to about 4 weight percent of a mono- or di-chlorinated $C_2$ or $C_3$ alkane selected from the group consisting of 1I-chloropropane, 2-chloropropane and 1,1-dichloroethane, wherein said compositions with 1 chloropropane or 2-chloropropane boil at about 30.9° C. at 760 mn Hg and said compositions with 1,1-dichloroethane boil at about 29.8° C. at 760 mm Hg.

2. Azeotrope-like compositions consisting essentially of from about 25 to about 98 weight percent 1,1-dichloro-1-fluoroethane, from about 1 to about 67 weight percent 1,1-dichloro-2,2,2-trifluoroethane, from about 0.5 to about 4 weight percent 2-chloropropane, and from about 1 to about 4 weight percent methanol which boil at about 30.9° C. at 760 mm Hg.

3. The azeotrope-like compositions of claim 2 wherein said compositions consist essentially of from about 57 to about 97 weight percent 1,1-dichloro-1-fluoroethane, from about 1 to about 35 weight percent 1,1-dichloro-2,2,2-trifluoroethane, from about 0.5 to about 4 weight 2-chloropropane, and from about 1 to about 4 weight percent methanol.

4. The azeotrope-like compositions of claim 2 wherein said compositions consist essentially of from about 62 to about 95 weight percent 1,1-dichloro-1-fluoroethane, from about 2 to about 31 weight percent 1,1-dichloro-2,2,2-trifluoroethane, from about 1 to about 3 weight percent 2-chloropropane, and from about 2 to about 4 weight percent methanol.

5. The azeotrope-like compositions of claim 2 wherein said compositions consist essentially of from about 63 to about 92 weight percent 1,1-dichloro-1-fluoroethane, from about 5 to about 30 weight percent 1,1-dichloro-2,2,2-trifluoroethane, from about 2 to about 4 weight percent methanol, and from about 1 to about 3 weight percent 2-chloropropane.

6. Azeotrope-like compositions consisting essentially of from about 25 to about 98 weight percent 1,1-dichloro-1-fluoroethane, from about 1 to about 69 weight percent 1,1-dichloro-2,2,2-trifluoroethane from about 0.1 to about 2 weight percent 1-chloropropane, and from about 1 to about 4 weight percent methanol which boil at about 30.9° C. at 760 mm Hg.

7. The azeotrope-like compositions of claim 6 wherein said compositions consist essentially of from about 59 to about 98 weight percent 1,1-dichloro-1-fluoroethane, from about 1 to about 35 weight percent 1,1-dichloro-2,2,2-trifluoroethane, from about 0.1 to about 2 weight 1-chloropropane, and from about 1 to about 4 weight percent methanol.

8. The azeotrope-like compositions of claim 6 wherein said compositions consist essentially of from about 63 to about 96 weight percent 1,1-dichloro-1-fluoroethane, from about 2 to about 31 weight percent 1,1-dichloro-2,2,2-trifluoroethane, from about 0.2 to about 2 weight 1-chloropropane, and from about 2 to about 4 weight percent methanol.

9. The azeotrope-like compositions of claim 6 wherein said compositions consist essentially of from about 65 to about 93 weight percent 1,1-dichloro-1-fluoroethane, from about 5 to about 30 weight percent 1,1-dichloro-2,2,2-trifluoroethane, from about 0.2 to about 1 weight 1-chloropropane, and from about 2 to about 4 weight percent methanol.

10. Azeotrope-like compositions consisting essentially of from about 25 to about 98 weight percent 1,1-dichloro-1-fluoroethane, from about 1 to about 66 weight percent 1,1-dichloro-2,2,2-trifluoroethane, from about 0.1 to about 3 weight 1,1-dichloroethane, and from about 1 to about 6 weight percent methanol which boil at about 29.8° C. at 760 mm Hg.

11. The azeotrope-like compositions of claim 10 wherein said compositions consist essentially of from about 55 to about 98 weight percent 1,1-dichloro-1-fluoroethane, from about 1 to about 37 weight percent 1,1-dichloro-2,2,2-trifluoroethane, from about 0.1 to about 2 weight percent 1,1-dichloroethane, and from about 1 to about 6 weight percent methanol.

12. The azeotrope-like compositions of claim 10 wherein said compositions consist essentially of from about 59 to about 96 weight percent 1,1-dichloro-1-fluoroethane, from about 2 to about 32 weight percent 1,1-dichloro-2,2,2-trifluoroethane, from about 0.1 to about 2 weight percent 1,1-dichloroethane, and from about 2 to about 6 weight percent methanol.

13. The azeotrope-like compositions of claim 10 wherein said compositions consist essentially of from about 62 to about 93 weight percent 1,1-dichloro-1-fluoroethane, from about 5 to about 30 weight percent 1,1-dichloro-2,2,2-trifluoroethane, from about 0.1 to about 2 weight percent 1,1-dichloroethane, and from about 2 to about 6 weight percent methanol.

14. The azeotrope-like compositions of claim 1 wherein said dichlorotrifluoroethane is 1,1-dichloro-2,2,2-trifluoroethane.

15. The azeotrope-like compositions of claim 1 wherein said dichlorotrifluoroethane is 1,2-dichloro-1,2,2-trifluoroethane.

16. The azeotrope-like compositions of claim 1 wherein said dichlorotrifluoroethane is a mixture of 1,1-dichloro-1,2,2-trifluoroethane and 1,2-dichloro-1,2,2-trifluoroethane.

17. The azeotrope-like compositions of claim 1 wherein an effective amount of a stabilizer is present in said compositions.

18. A method of cleaning a solid surface comprising treating said surface with an azeotrope-like composition of claim 1.

19. A method of cleaning a solid surface comprising treating said surface with an azeotrope-like composition of claim 2.

20. A method of cleaning a solid surface comprising treating said surface with an azeotrope-like composition of claim 6.

21. A method of cleaning a solid surface comprising treating said surface with an azeotrope-like composition of claim 10.

22. Azeotrope-like compositions consisting essentially of from about 25 to about 98 weight percent 1,1-dichloro-1-fluoroethane, from about 1 to about 67 weight percent, 1,2-dichloro-1,2,2-trifluoroethane, from about 0.5 to about 4 weight percent 2.chloropropane, and from about 1 to about 4 weight percent methanol which boil at about 30.9° C. at 760 mm Hg.

23. Azeotrope-like compositions consisting essentially of from about 25 to about 98 weight percent 1,1-dichloro-1-fluoroethane, from about 1 to about 67 weight percent of a mixture of 1,1-dichloro-2,2,2-trifluoroethane and 1,2-dichloro-1,2,2-trifluoroethane, from about 0.5 to about 4 weight percent 2-chloropropane, and from about 1 to about 4 weight percent methanol which boil at about 30.9° C. at 760 mm Hg.

24. Azeotrope-like compositions consisting essentially of from about 25 to about 98 weight percent 1.1-dichloro-1-fluoroethane, from about 1 to about 69 weight percent, 1,2-dichloro-1,2,2-trifluoroethane from about 0.1 to about 2 weight percent 1-chloropropane, and from about 1 to about 4 weight percent methanol which boil at about 30.9° C. at 760 mm Hg.

25. Azeotrope-like compositions consisting essentially of from about 25 to about 98 weight percent 1,1-dichloro-1-fluoroethane, from about 1 to about 69 weight percent of a mixture of 1,1-dichloro-2,2,2-trifluoroethane and 1,2-dichloro-1,2,2-trifluoroethane from about 0.1 to about 2 weight percent 1-chloropropane, and from about 1 to about 4 weight percent methanol which boil at about 30.9° C. at 760 mm Hg.

26. A method of cleaning a solid surface comprising treating said surface with an azeotrope-like composition of claim 20.

27. A method of cleaning a solid surface comprising treating said surface with an azeotrope like composition of claim 21.

28. The azeotrope-like compositions of claim 26 wherein said compositions consist essentially of from about 57 to about 97 weight percent 1,1-dichloro-1-fluoroethane, from about 1 to about 35 weight percent 1,2-dichloro-1,2,2-trifluoroethane, from about 0.5 to about 4 weight percent 2-chloropropane, and from about 1 to about 4 weight percent methanol.

29. The azeotrope-like compositions of claim 27 wherein said compositions consist essentially of from about 57 to about 97 weight percent 1,1-dichloro-1-fluoroethane, from about 1 to about 35 weight percent of a mixture of 1,1-dichloro-2,2,2-trifluoroethane and 1,2-dichloro-1,2,2-trifluoroethane, from about 0.5 to about 4 weight percent 2-chloropropane, and from about 1 to about 4 weight percent methanol.

30. The azeotrope-like compositions of claim 26 wherein said compositions consist essentially of from about 62 to about 95 weight percent 1,1-dichloro-1-fluoroethane, from about 2 to about 31 weight percent 1,2-dichloro-1,2,2-trifluoroethane, from about 1 to about 3 weight percent 2-chloropropane, and from about 2 to about 4 weight percent methanol.

31. The azeotrope-like compositions of claim 27 wherein said compositions consist essentially of from about 62 to about 95 weight percent 1,1-dichloro-1-fluoroethane, from about 2 to about 31 weight percent of a mixture of 1,1-dichloro-2,2,2-trifluoroethane and 1,2-dichloro-1,2,2-trifluoroethane from about 1 to about 3 weight percent 2-chloropropane, and from about 2 to about 4 weight percent methanol.

32. The azeotrope-like compositions of claim 26 wherein said compositions consist essentially of from about 63 to about 92 weight percent 1,1-dichloro-1-fluoroethane, from about 5 to about 30 weight percent 1,2-dichloro-1,2,2-trifluoroethane, from about 2 to about 4 weight percent methanol, and from about 1 to about 3 weight percent 2-chloropropane.

33. The azeotrope-like compositions of claim 27 wherein said compositions consist essentially of from about 63 to about 92 weight percent 1,1-dichloro-1-fluoroethane, from about 5 to about 30 weight percent of a mixture of 1,1-dichloro-2,2,2-trifluoroethane and 1,2-dichloro-1,2,2-trifluoroethane from about 2 to about 4 weight percent methanol, and from about 1 to about 3 weight percent 2-chloropropane.

34. A method of cleaning a solid surface comprising treating said surface with an azeotrope-like composition of claim 24.

35. A method of cleaning a solid surface comprising treating said surface with an azeotrope-like composition of claim 25.

36. The azeotrope-like compositions of claim 24 wherein said compositions consist essentially of from about 59 to about 98 weight percent 1,1-dichloro-1-fluoroethane, from about 1 to about 35 weight percent 1,2-dichloro-1,2,2-trifluoroethane, from about 0.1 to about 2 weight percent 1-chloropropane, and from about 1 to about 4 weight percent methanol.

37. The azeotrope-like compositions of claim 25 wherein said compositions consist essentially of from about 59 to about 98 weight percent 1,1-dichloro-1-fluoroethane, from about 1 to about 35 weight percent of a mixture of 1,1-dichloro-2,2,2-trifluoroethane and 1,2-dichloro-1 2,2-trifluoroethane from about 0.1 to about 2 weight percent 1-chloropropane, and from about 1 to about 4 weight percent methanol.

38. The azeotrope-like compositions of claim 24 wherein said compositions consist essentially of from about 63 to about 96 weight percent 1,1-dichloro-1-fluoroethane, from about 2 to about 31 weight percent 1,2-dichloro-1,2,2-trifluoroethane, from about 0.2 to about 2 weight percent 1-chloropropane, and from about 2 to about 4 weight percent methanol.

39. The azeotrope-like compositions of claim 25 wherein said compositions consist essentially of from about 63 to about 96 weight percent 1,1-dichloro-1-fluoroethane, from about 2 to about 31 weight percent of a mixture of 1,1-dichloro-2,2,2-trifluoroethane and 1,2-dichloro-1,2,2-trifluoroethane from about 0.2 to about 2 weight percent 1-chloropropane, and from about 2 to about 4 weight percent methanol.

40. The azeotrope-like compositions of claim 24 wherein said compositions consist essentially of from about 65 to about 93 weight percent 1,1-dichloro-1-fluoroethane, from about 5 to about 30 weight percent 1,2-dichloro-1,2 2-trifluoroethane, from about 0.2 to about 1 weight percent 1-chloropropane, and from about 2 to about 4 weight percent methanol.

41. The azeotrope-like compositions of claim 25 wherein said compositions consist essentially of from about 65 to about 93 weight percent 1,1-dichloro-1-fluoroethane, from about 5 to about 30 weight percent of a mixture of 1,1-dichloro-2,2,2-trifluoroethane and 1,2-dichloro-1,2,2-trifluoroethane from about 0.2 to about 1 weight percent 1-chloropropane, and from about 2 to about 4 weight percent methanol.

42. Azeotrope-like compositions consisting essentially of from about 25 to about 98 weight percent 1,1-dichloro-1-fluoroethane, from about 1 to about 66 weight percent 1,2-dichloro-1,2,2-trifluoroethane, from about 0.1 to about 3 weight percent 1,1-dichloroethane, and from about 1 to about 6 weight percent methanol, which boil at about 29.8° C. at 760 mm Hg.

43. Azeotrope-like compositions consisting essentially of from about 25 to about 98 weight percent 1,1-dichloro-1-fluoroethane, from about 1 to about 66 weight percent of a mixture of 1,1-dichloro-2,2,2-trifluoroethane and 1,2-dichloro-1,2,2-trifluoroethane, from about 0.1 to about 3 weight percent 1,1-dichloroethane, and from about 1 to about 6 weight percent methanol which boil at about 29.8° C. at 760 mm Hg.

44. The azeotrope-like compositions of claim 42 wherein said compositions consist essentially of from about 55 to about 98 weight percent 1,1-dichloro-1-fluoroethane, from about 1 to about 37 weight percent 1,2-dichloro-1,2,2-trifluoroethane, from about 0.1 to about 2 weight percent, 1,1-dichloroethane, and from about 1 to about 6 weight percent methanol.

45. The azeotrope-like compositions of claim 43 wherein said compositions consist essentially of from about 55 to about 98 weight percent 1,1-dichloro-1-fluoroethane, from about 1 to about 37 weight percent of a mixture of 1,1-dichloro-2,2,2-trifluoroethane and 1,2-dichloro-1,2,2-trifluoroethane from about 0.1 to about 2 weight percent 1,1-dichloroethane, and from about 1 to about 6 weight percent methanol.

46. The azeotrope-like compositions of claim 42 wherein said compositions consist essentially of from about 59 to about 96 weight percent 1,1-dichloro-1-fluoroethane, from about 2 to about 32 weight percent 1,2-dichloro-1,2,2-trifluoroethane, from about 0.1 to about 2 weight percent 1,1-dichloroethane, and from about 2 to about 6 weight percent methanol.

47. The azeotrope-like compositions of claim 43 wherein said compositions consist essentially of from about 59 to about 96 weight percent 1,1-dichloro-1-fluoroethane, from about 2 to about 32 weight percent and a mixture of 1,1-dichloro-2,2,2-trifluoroethane and 1,2-dichloro-1,2,2-trifluoroethane, from about 0.1 to about 2 weight percent 1,1-dichloroethane, and from about 2 to about 6 weight percent methanol.

48. The azeotrope like compositions of claim 42 wherein said compositions consist essentially of from about 62 to about 93 weight percent 1,1-dichloro-1-fluoroethane, from about 5 to about 30 weight percent 1,2-dichloro-1,2 2-trifluoroethane, from about 0.1 to about 2 weight percent, 1,1-dichloroethane, and from about 2 to about 6 weight percent methanol.

49. The azeotrope-like compositions of claim 43 wherein said compositions consist essentially of from about 62 to about 93 weight percent 1,1-dichloro-1-fluoroethane, from about 5 to about 30 weight percent of a mixture of 1,1-dichloro-2,2,2-trifluoroethane and 1,2-dichloro-1,2,2-trifluoroethane from about 0.1 to about 2 weight percent 1,1-dichloroethane, and from about 2 to about 6 weight percent methanol.

50. A method of cleaning a solid surface comprising treating said surface with an azeotrope like composition of claim 42.

51. A method of cleaning a solid surface comprising treating said surface with an azeotrope-like composition of claim 43.

* * * * *